United States Patent [19]

Oglesbee

[11] 4,192,421

[45] Mar. 11, 1980

[54] CUSHIONING PADS FOR CARTONS

[75] Inventor: Richard K. Oglesbee, Lancaster, Ohio

[73] Assignee: Anchor Hocking Corporation, Lancaster, Ohio

[21] Appl. No.: 884,279

[22] Filed: Mar. 7, 1978

[51] Int. Cl.[2] ..... B65D 81/06; B65D 85/44

[52] U.S. Cl. ..... 206/426; 206/523; 217/34

[58] Field of Search ..... 206/193, 426, 433, 523, 206/591, 593-594; 229/15, 28 R, 28 B, 4 L, DIG. 1, DIG. 4; 217/29-34

[56] References Cited

U.S. PATENT DOCUMENTS

| | | | |
|---|---|---|---|
| 1,019,665 | 3/1912 | LeDoyen | 217/30 |
| 1,621,904 | 3/1927 | Russell et al. | 217/34 |
| 3,256,527 | 6/1966 | Studen | 206/523 X |
| 3,421,679 | 1/1969 | Goldman | 206/523 X |
| 3,456,782 | 7/1969 | Miller | 217/27 X |

*Primary Examiner*—Davis T. Moorhead
*Attorney, Agent, or Firm*—Alexander C. Wilkie, Jr.

[57] ABSTRACT

An improved cushion pad is disclosed for use in packaging glassware or other fragile articles in a compartmented carton. Such cartons, including the well known corrugated fiberboard cartons, are used with vertical dividers for packaging articles having extending extremities such as glass stemware, whose projecting feet and flaring tops may project into adjacent compartments and engage and chip or crack one another. The cushions of this invention have preformed grooves to receive the tops and bottoms of the dividers causing the extremities of the articles to be positioned away from the spaces between dividers thereby preventing them from striking one another during carton handling.

2 Claims, 5 Drawing Figures

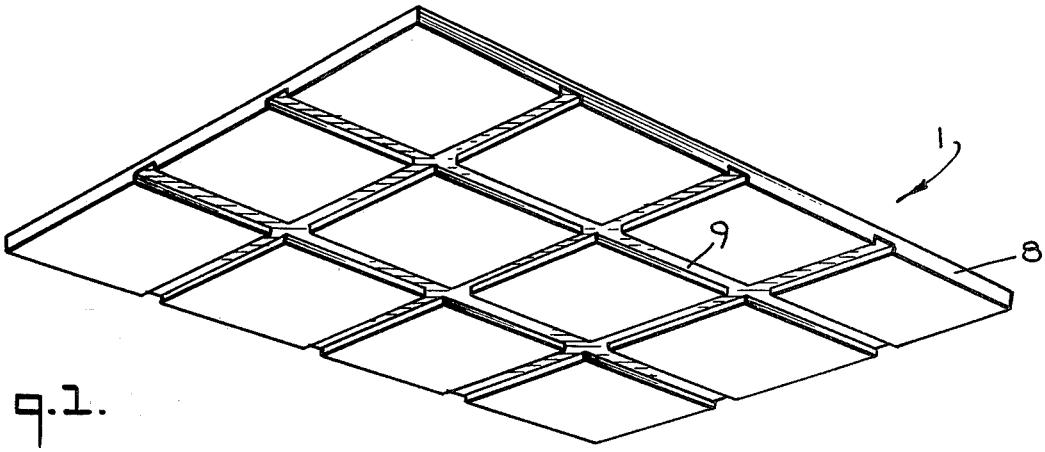
Fig. 1.
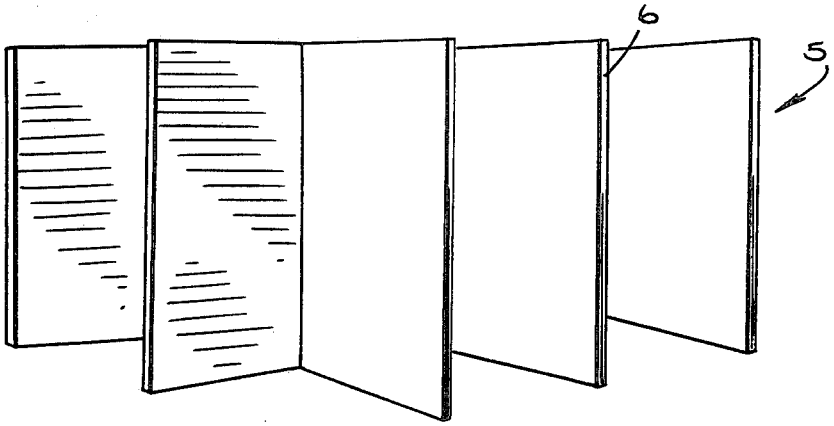
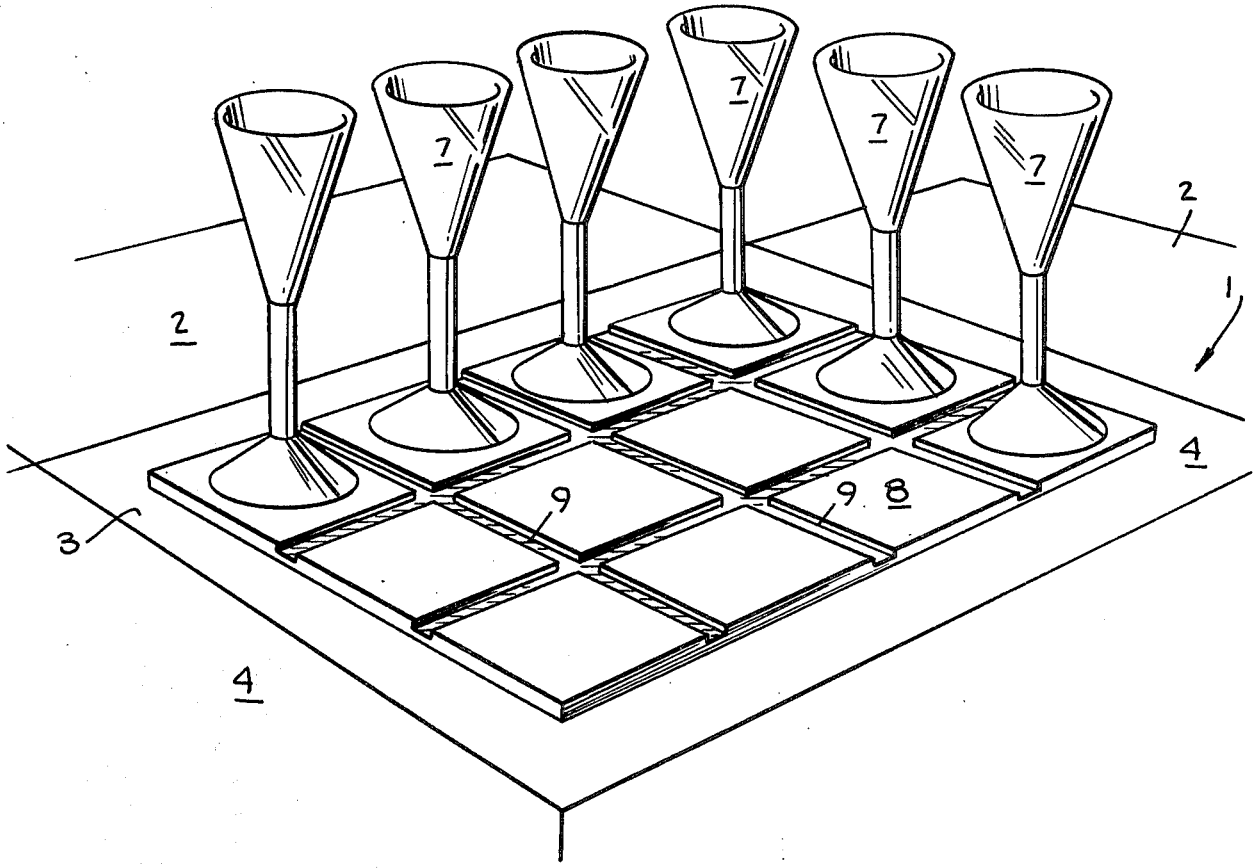

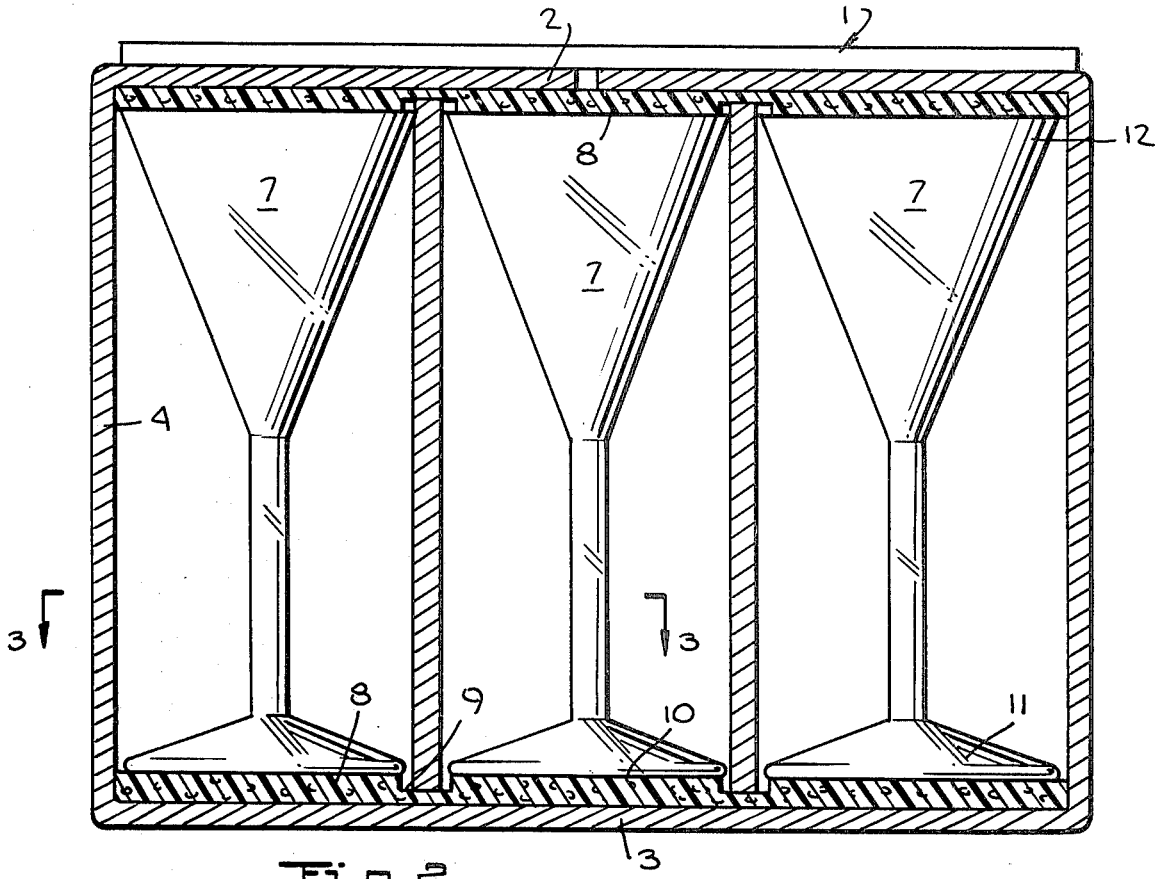
Fig. 2.
Fig. 3.
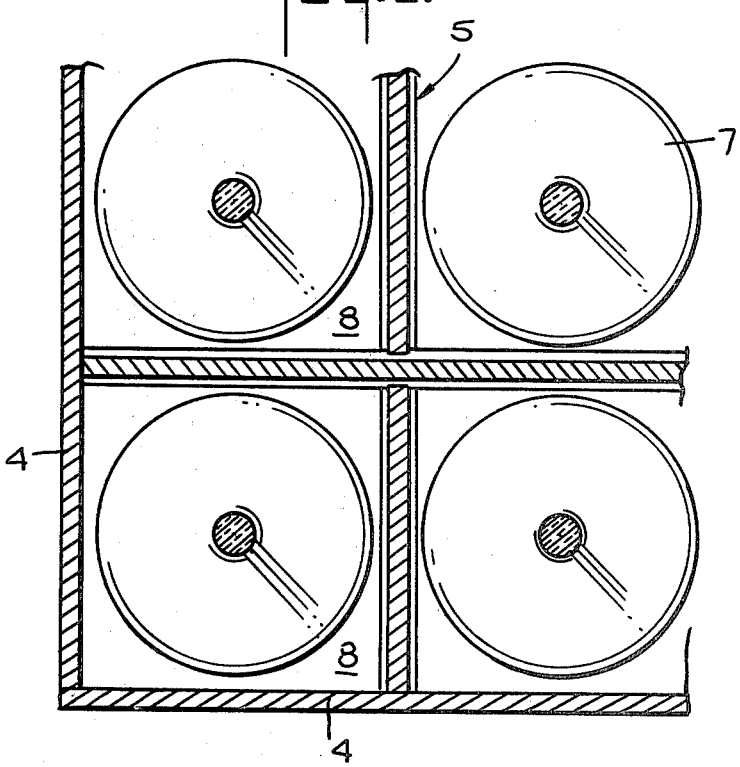
Fig. 4.
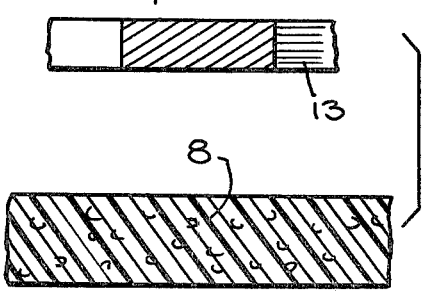
Fig. 5.
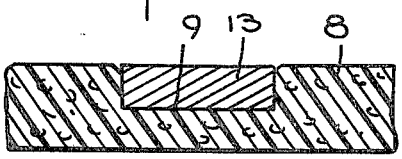

CUSHIONING PADS FOR CARTONS

BACKGROUND OF INVENTION

The present invention relates to improvements in packaging and more particularly to improved cushioning pads for use in compartmented cartons to protect the projecting extremities of fragile articles such as glass stemware and the like.

Glass stemware and other fragile articles are conventionally packed in corrugated fiberboard cartons or similar cartons having dividers for forming separate article compartments. One type of divider which is in wide use is formed of interconnected slotted sheets set up in a grid-like form for insertion into the erected cartons. Where glass stemware or other objects having projecting extremities are placed in the compartments, damage has resulted when the extremities work their way over or under the dividers and come into contact with one another. It has been suggested that this problem may be alleviated by inserting members between the dividers and the carton walls which are especially shaped to surround the extremities of the packaged articles and to hold them in place. One such means, is illustrated, for example, in U.S. Pat. No. 3,456,782 dated July 22, 1969. These members have especially shaped and complicated recesses and projections for holding the packaged articles clear of the divider ends.

The cushioning pad of the present invention provides a relatively resilient cushion member having simple intersecting grooves formed therein for providing an article protecting structure. A preferred cushioning pad, for example, may be formed of a cellular material with the intersecting grooves being molded into the material either before or after the expansion of the material to its final cellular form.

Accordingly, the object of the present invention is to provide an improved package for glass stemware or similar fragile articles having projecting extremities.

Another object of the present invention is to provide an improved means for protecting packaged articles such as glass or plastic stemware.

Another object of the present invention is to provide an effective and simple cushioning pad for packaging articles in compartmented cartons.

Another object of the present invention is to provide an improved method of forming a cushion pad for a compartmented container.

Other and further objects of the invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein:

FIG. 1 is an exploded perspective view of a package for stemware in accordance with the present invention.

FIG. 2 is a vertical sectional view of the package of FIG. 1.

FIG. 3 is a horizontal sectional view of the package of FIG. 2, taken along line 3—3 on FIG. 2.

FIGS. 4 & 5 illustrate die means shaping a cushioning pad in accordance with an embodiment of the present invention.

DESCRIPTION OF THE PREFERRED EMBODIMENT

The drawings illustrate a carton used for packaging glass goblets which have projecting feet as well as a projecting or flared upper goblet portion. These articles have been chosen as being representative of fragile articles such as stemware or similar articles which are packed and shipped in sets or groups. The drawings show a paperboard carton such as the well known folded corrugated fiberboard carton in which such articles are normally packaged and shipped. The carton includes paperboard dividers for separating the packaged stemware. These partitions, for example, usually comprise rectangular cut sheets having interlocking grooves so that they may be assembled in the form illustrated in FIG. 1. Thus, the carton 1 shown has a top 2 and a bottom 3 connected by side walls 4. The divider 5 comprises interlocked slotted sheets 6 assembled to form compartments for the packaged stemware 7. While the divider sheets 6 are normally cut to extend the full distance between carton tops 2 and bottoms 3 differences in the exact carton dimensions together with carton flexure during shipment results in open spaces occuring between the ends of the dividers 5 and the adjacent carton top 2 or bottom 3.

These openings permit the extremities of the packaged stemware 7 to slip under or over the dividers 5 causing the above referred to cracking or chipping. This result is prevented by the insertion of the cushioning pads 8 between the dividers 5 and the carton top 2 and bottom 3. Each of the cushion pads 8 are formed with a thickness several times that of the openings which may exist between the dividers 5 and the carton tops 2 or bottoms 3. This permits relatively deep grooves 9 to be formed in the cushion pads 8 to receive the ends of the dividers 5.

The result is clearly illustrated in FIGS. 2 and 3 which show the carton 1 containing the stemware 7 in the form of cocktail glasses having both projecting feet 11 and projecting flared rims 12. In this carton 1, cushioning pads 8 are used at both the tops and bottoms of the stemware 7 to prevent inadvertent contact between the flared rims 12 of the adjacent pieces and between the projecting feet 11. In other packages, the pads need only be utilized at one end of the article when the article shape itself may prevent such contact. In the event that several layers of stemware are packed within a single carton, pads may be used having grooves formed on both surfaces. Such a pad would be used for example, between the layers of a two layer carton.

One embodiment of the pads 8 is formed of foamed or cellular sheet material, however, other materials may be used. The foamed materials are normally thermoplastic so that the above described grooves may be formed using appropriately shaped and heated dies 13 as illustrated in FIGS. 4 & 5. The heated dies partially melt the plastic to release the trapped gas and deflate the grooved areas. The foam material, such as a polystyrene foam or other closed-cell foamed materials, is advantageous because they provide a cushioning action for the packed articles in addition to the above described separating function. Additionally, the cushioning pads formed of foam material are relatively light in weight so that they add only an insignificant amount of weight to the sealed packages.

Where materials other than the cellular plastics are used such as fiberboard or corrugated materials, methods other than the above described heated moulding are used including embossing or extrusion steps for forming the grooves.

It is therefore clear that improvements have been described for use for packaging fragile articles such as glass stemware or other fragile articles with flanged or projecting extremities. The cushioning pads, in accordance with the invention, protect such articles from inadvertent breakage and are inexpensively formed and applied and may be added to the packages with only a minimum increase in the weight of the packages.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described my invention, I claim:

1. A package containing a plurality of relatively fragile articles having projecting extremities at one end comprising the combination of:

an outer carton with top and bottom members and side walls;

a divider contained within said carton formed of intersecting divider sheets extending from the carton top member to the carton bottom member and defining compartments;

one of said fragile articles positioned in each of the compartments;

the projecting extremities of all of said articles being adjacent to the same one of said members;

a cushioning pad positioned between said divider and said same one of said members and having a plurality of preformed intersecting grooves therein facing the other of said members and with each sheet of said divider being received in one of said grooves;

the elevated portions of the cushioning pad between the said grooves engaging the projecting extremities of the packaged articles whereby these projecting extremities are held inwardly of the divider from the divider sheet edges and are thereby completely separated from one another by the divider sheets.

2. The package as claimed in claim 1 in which said cushioning pads comprises expanded foamed plastic with the grooves being formed by heated dies.

* * * * *